US008011702B2

(12) United States Patent
Tien et al.

(10) Patent No.: US 8,011,702 B2
(45) Date of Patent: Sep. 6, 2011

(54) OUTER OPERATIONAL DEVICE FOR PANIC EXIT DOOR LOCK

(75) Inventors: Hung-Jen Tien, Tainan (TW); Chen-Wei Huang, Tainan (TW)

(73) Assignee: I-Tek Metal Mfg. Co., Ltd., Tainan (TW)

( * ) Notice: Subject to any disclaimer, the term of this patent is extended or adjusted under 35 U.S.C. 154(b) by 450 days.

(21) Appl. No.: 12/264,310

(22) Filed: Nov. 4, 2008

(65) Prior Publication Data

US 2010/0109352 A1 May 6, 2010

(51) Int. Cl.
*E05B 3/00* (2006.01)

(52) U.S. Cl. ..... 292/336.3; 292/92; 292/21; 70/92

(58) Field of Classification Search ..... 292/336.3, 292/92, 21; 70/92, 107, 111, 210, 211
See application file for complete search history.

(56) References Cited

U.S. PATENT DOCUMENTS

| | | | | |
|---|---|---|---|---|
| 4,741,563 A | | 5/1988 | Cohrs | 292/21 |
| 4,961,330 A | | 10/1990 | Evans | 292/21 |
| 4,974,890 A | | 12/1990 | Cohrs | 292/363.3 |
| 5,520,427 A | | 5/1996 | Mader | 292/336.3 |
| 5,564,760 A | | 10/1996 | Mader | 292/182 |
| 5,566,994 A | | 10/1996 | Mader | 292/336.3 |
| 5,570,916 A | | 11/1996 | Mader | 292/336.3 |
| 5,658,026 A | * | 8/1997 | Nigro et al. | 292/336.3 |
| 5,664,816 A | * | 9/1997 | Nigro et al. | 292/336.3 |
| 7,181,940 B2 | * | 2/2007 | Lin | 70/472 |
| 7,364,212 B1 | | 4/2008 | Fan | 292/336.3 |
| 7,634,927 B1 | * | 12/2009 | Tien | 70/92 |

* cited by examiner

*Primary Examiner* — Carlos Lugo
*Assistant Examiner* — Mark Williams
(74) *Attorney, Agent, or Firm* — Alan Kamrath; Kamrath & Associates PA

(57) ABSTRACT

An outer operational device includes a cover mounted to a side of a door. An actuating member is mounted in the cover and includes an end engaged with a handle to rotate therewith. A sliding member is slideably received in the cover and operably connected to the actuating member, so that the sliding member slides when the actuating member rotates. A limiting member is pivotably received in the cover between a blocking position not allowing movement of the sliding member and a release position allowing movement of the sliding member. The handle is rotatable when the limiting member is in the release position. The handle is not rotatable when the limiting member is in the blocking position. A key-operable lock core is operably connected to the actuating member, so that the limiting member can be moved to the blocking position to provide a burglarproof function.

11 Claims, 16 Drawing Sheets

OUTER OPERATIONAL DEVICE FOR PANIC EXIT DOOR LOCK

BACKGROUND OF THE INVENTION

The present invention relates to an outer operational device for a panic exit door lock and, more particularly, to an outer operational device for a panic exit door lock that includes a handle for unlocking purposes.

Panic exit door locks of the type having top and bottom latches for burglarproof purposes generally include an outer operational device that can be operated to unlock the door. U.S. Pat. No. 5,570,916 discloses a door lever assembly for disengaging an unlocked latch of a lockable door latch assembly. The door lever assembly includes a lever handle rotatably connected to a trim housing supporting a stop plate. A cam is operably connected to the lever handle and positioned to rotate in response to rotation of the lever handle, converting its rotational movement to linear movement of a movable slider positioned adjacent to the cam. A lift arm is operably connected to vertical rods of the door latch assembly, and an over-ride spring is connected between the slider and the lift arm. The over-ride spring transmits motion of the slider to lift the lift arm and the connected vertical rods when the door latch assembly is in an unlocked position. The over-ride spring compresses in response to slider movement when a blocking slide is positioned to block movement of the lift arm when the door latch assembly is in its locked position, preventing damage to components of the door lever assembly. In an unlocked position, a pivot rotates to control contact between the slider and the stop plate. However, troublesome installation is required when mounting such a door latch assembly to a differently handed door. Furthermore, such a door latch assembly can not provide the burglarproof function by itself, so that it must be utilized with a door lock with a burglarproof function.

Thus, a need exists for an outer operational device for a panic exit door lock that provides a burglarproof function and that can be mounted to differently handed doors with less effort.

BRIEF SUMMARY OF THE INVENTION

The present invention solves this need and other problems in the field of panic exit door locks by providing, in a preferred form, an outer operational device including a cover adapted to be mounted to a side of a door. The cover defines a space. A handle includes a shank having an engaging portion with non-circular cross sections. The shank is rotatably received in the cover. An actuating member is mounted in the space and includes an end and a non-circular connecting hole engaged with the engaging portion to rotate therewith. A sliding member is slideably received in the space and includes a pressing face abutting against the end of the actuating member, so that the sliding member slides when the actuating member rotates. A limiting member is pivotably received in the space. The limiting member includes a pivotal portion and a stop. The stop includes a follower portion. The limiting member is pivotable between a blocking position not allowing movement of the sliding member and a release position allowing movement of the sliding member. The handle is rotatable when the limiting member is in the release position. The handle is not rotatable when the limiting member is in the blocking position. A driving member is fixed to the sliding member to move therewith. The driving member includes a rod adapted to couple with a panic exit door lock mounted to the other side of the door. The rod is movable to control locking or unlocking of the panic exit door lock. A cylinder is mounted to the cover and includes a lock core rotatably mounted therein. An actuator is mounted outside of the cylinder and fixed to the lock core to rotate therewith. A mover is rotatably mounted around the cylinder and includes a tab and an actuating bar. The tab is operably connected to the actuator. The actuating bar is operably connected to follower portion, such that the mover is rotated to move the limiting member between the blocking position and the release position when the actuator is rotated.

The outer operational device provides normal locking/unlocking operation of the panic exit door lock by rotating the handle while the limiting member is in the release position. When a burglarproof function is required, the lock core can be rotated by a key to move the limiting member to the blocking position, so that the handle can not be rotated.

The present invention will become clearer in light of the following detailed description of illustrative embodiments of this invention described in connection with the drawings.

DESCRIPTION OF THE DRAWINGS

The illustrative embodiments may best be described by reference to the accompanying drawings where.

Figure 1:
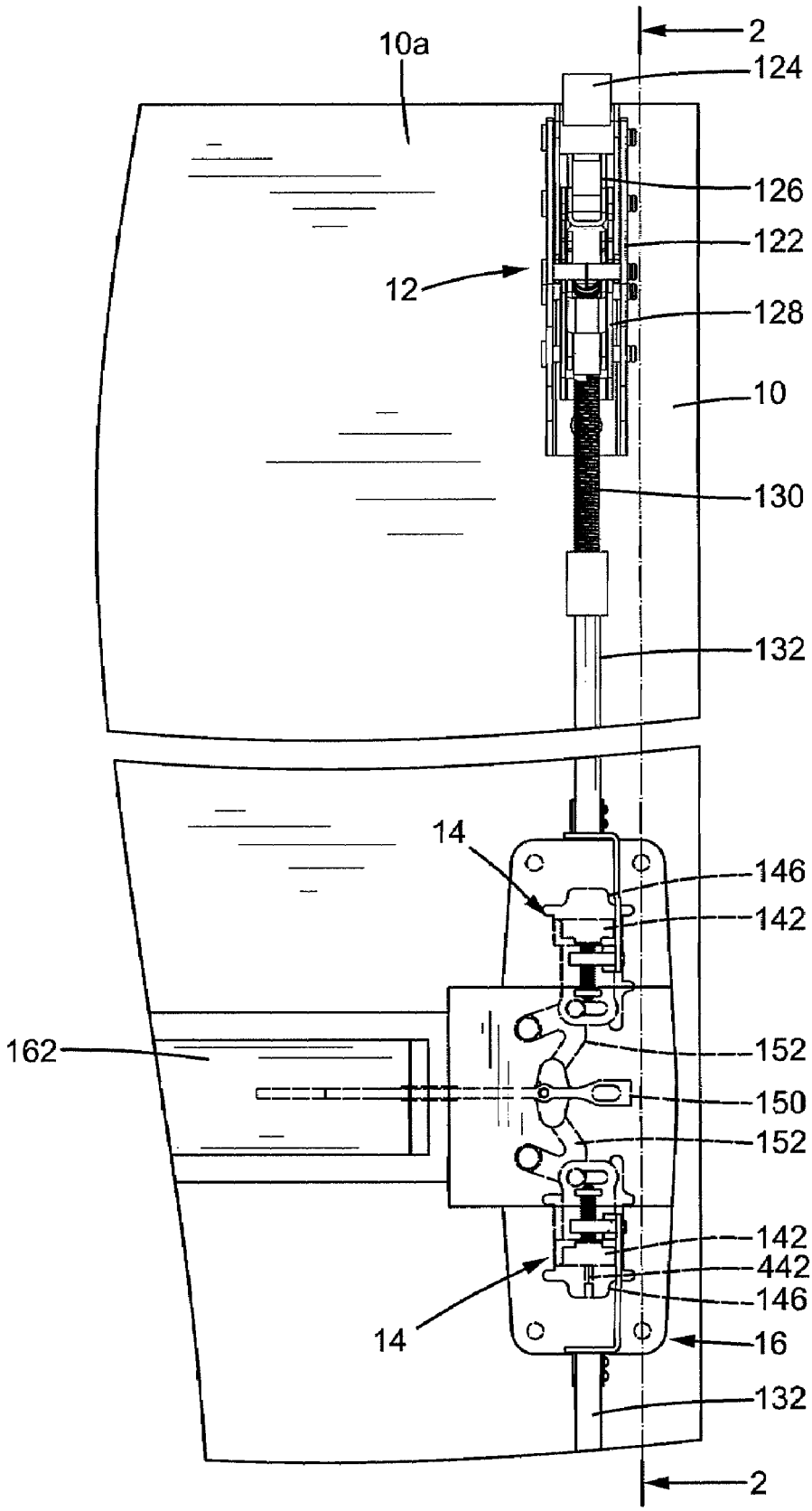
FIG. 1 shows a partial, side elevational view of a panic exit door, a lock mounted to a side of the door, and an outer operational device according to the preferred teachings of the present invention mounted to the other side of the door.

All figures are drawn for ease of explanation of the basic teachings of the present invention only; the extensions of the figures with respect to number, position, relationship, and dimensions of the parts to form the preferred embodiments will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "lower", "upper", "inner", "outer", "side", "end", "portion", "section", "axial", "lateral", "horizontal", "vertical", "annular", "inward", "spacing", "clockwise", "counterclockwise", "length", "height", and similar terms are used herein, it should be understood that these terms have reference only to the structure shown in the drawings as it would appear to a person viewing the drawings and are utilized only to facilitate describing the invention.

DETAILED DESCRIPTION OF THE INVENTION

An outer operational device according to the preferred teachings of the present invention is shown in the drawings and adapted to be mounted to a side of a door 10 for operating a lock mounted to the other side of door 10. According to the preferred form shown, the lock includes a follower device 16 and a latch device 12 operably connected to follower device 16. Door 10 is hinged to a door frame 102 and includes an inner side 10*a* and an outer side 10*b*. It is noted that inner and outer sides 10*a* and 10*b* are exchanged when door 10 is installed as a differently handed door. According to the most preferred form shown, door 10 is installed as a right-handed door. Furthermore, door 10 includes a mounting hole 106 extending from inner side 10*a* through outer side 10*b*. Door frame 102 includes top and bottom strikers 104. When door 10 is closed, inner side 10*a* abuts against an end face of door frame 102. Follower device 16 and latch device 12 are mounted to inner side 10*a* of door 10, and outer operational device according to the preferred teachings of the present invention is mounted to outer side 10*b*.

According to the preferred form shown, follower device 16 includes a base 144 having two slots 146. A sliding device 14 is mounted in each slot 146. Specifically, each sliding device 14 includes a slide 142 slideably received in one of slots 146. Follower device 16 includes a linking rod 150 that is operably connected to slides 142 by two links 152. Follower device 16 further includes an operative member 162 in the most preferred form shown as a press bar operably connected to linking rod 150. When operative member 162 is pressed, linking rod 150 is moved in an unlatching direction to move links 152 toward each other, which in turn, moves slides 142 toward each other.

According to the preferred form shown, latch device 12 is of surfaced type and includes top and bottom latches 124. Specifically, latch device 12 includes upper and lower casings 122 in which top and bottom latches 124 are pivotably mounted. A follower 128 is slideably mounted in each casing 122. A connecting rod 126 is mounted between each follower 128 and one of latches 124. Specifically, an end of each connecting rod 126 is pivotably connected to one of latches 124. The other end of each connecting rod 126 is pivotably connected to an end of one of followers 128. The other end of each follower 128 is pivotably connected to an end of a screw rod 130. The other end of each screw rod 130 is threadedly coupled with an end of a coupling rod 132. The other end of each coupling rod 132 is coupled to one of slides 142.

When follower device 16 is not operated, latches 124 are in an extended, locking position outside of casings 122 and abut against strikers 104 (FIG. 2), not allowing opening of door 10. When operative member 162 is operated, slides 142 move toward each other. Coupling rods 132 are moved toward each other to cause movement of followers 128 and connecting rods 126. Thus, latches 124 are pivoted inward to a retracted, unlocking position inside of casings 124 allowing opening of door.

The outer operational device can be operated from outer side 10*b* of door 10 to move slides 142 for unlocking purposes. According to the preferred form shown, the outer operational device includes a cover 20 having a sidewall 202 extending in a vertical direction and an annular wall 204 extending perpendicularly along a periphery of sidewall 202, defining a space 200 between annular wall 204 and sidewall 202. Sidewall 202 includes a receiving portion 205 in an upper portion thereof. Receiving portion 205 extends into space 200 and forms a compartment 206. Furthermore, receiving portion 205 includes two parallel, spaced, chamfered faces 209 on an outer periphery thereof. Compartment 206 includes an opening 208 in communication with space 200. Sidewall 202 further includes upper and lower fixing holes 210 below opening 208. Sidewall 202 further includes an engaging hole 214 below fixing holes 210. A protrusion 215 extends from an inner face of sidewall 202 below engaging hole 214. Protrusion 215 includes a first groove 216 and a second groove 219 above first groove 216 and shallower than first groove 216 in a depth direction perpendicular to the vertical direction. Two pegs 218 are formed on the inner face of sidewall 202 and located above opening 208. Annular wall 204 includes two supports 217 on two inner, vertical faces thereof. Each support 217 has a height from sidewall 202 the same as that of protrusion 215. Sidewall 202 further includes a positioning hole 212 adjacent to upper fixing hole 210.

Two mounting posts 220 are engaged with screw holes in pegs 218. Furthermore, two additional mounting posts 220 are engaged with screw holes in protrusions 215. Cover 20 is mounted to outer side 10*b* of door 10 and covers mounting hole 106, with annular wall 204 abutting outer side 10*b* and with each mounting post 220 extending through mounting hole 106 to a position adjacent to base 144. A fastener 108 in the most preferred form shown as a screw is extended through base 144 into a screw hole in an end of each mounting post 220, so that base 144 is fixed to inner side 10*a* of door 10 and that cover 20 is fixed to outer side 10*b* of door 10.

According to the preferred form shown, the outer operational device further includes a sleeve 22 mounted to an outer face of sidewall 202 and in the most preferred form shown as a truncated cone. Sleeve 22 includes a central pivot hole 222 aligned with engaging hole 214 of cover 20. Fasteners 224 are extended through sidewall 202 into holes 226 in an end face of sleeve 22 to fix sleeve 22 on cover 20.

According to the preferred form shown, the outer operational device further includes a handle 24 having a stem 240 adapted to be gripped by a user and a shank 242 extending from an end of stem 240. Shank 242 includes an engaging portion 244 in the most preferred form shown having two chamfered faces 246 so that engaging portion 244 has non-circular cross sections. Shank 242 is pivotably received in pivot hole 222 of sleeve 22 about a pivot axis with engaging portion 244 outside of pivot hole 222. A retainer ring 248 in the most preferred form shown as a C-clip is mounted around shank 242 to prevent axial movement of handle 24 along the pivot axis.

According to the preferred form shown, the outer operational device further includes an actuating member 36 having a connecting hole 364 in an intermediate portion thereof. Two diametrically opposed rectangular grooves 366 are formed in an inner periphery of connecting hole 364. Actuating member 36 further includes first and second ends 360 and 362 on opposite sides of connecting hole 364. Shank 242 of handle 24 is received in connecting hole 364. Actuating member 36 abuts a side of retainer ring 248.

According to the preferred form shown, the outer operational device further includes a follower 38 in the most preferred form shown as a ring. Follower 38 includes a non-circular hole 382 corresponding to non-circular engaging portion 244 of handle 24 and extending along a central axis thereof. Follower 38 further includes two diametrically opposed teeth 380 extending in a direction parallel to and spaced from the central axis of follower 38. Engaging portion 244 of handle 24 is received in non-circular hole 382 of follower 38, with follower 38 intermediate actuating member 36 and retainer ring 248 and with teeth 380 engaged in grooves 366. Thus, handle 24 and follower 38 rotate jointly due to non-circular hole 382 and non-circular engaging portion 244. Furthermore, since teeth 380 of follower 38 are engaged in grooves 366 of actuating member 36, rotation of handle 24 also causes rotation of actuating member 36.

According to the preferred form shown, the outer operational device further includes a guide block 352 mounted in first groove 216 of cover 20 and having a size corresponding to first groove 216 of cover 20. Guide block 352 includes a sliding groove 353 extending in a vertical direction.

According to the preferred form shown, the outer operational device further includes an inner lid 46 having an opening 462 through which engaging portion 244 of handle 24 extends. A bend 466 is formed on an inner periphery of opening 462. Inner lid 46 further includes two parallel, spaced, elongated slots 460 above opening 462. Inner lid 46 further includes a support 464 below opening 462. Support 464 is formed by bending a portion of inner lid 46 and includes a vertical section 470 and a horizontal section 472. Inner lid 46 abuts protrusion 215 and supports 217, and fasteners 468 are extended through inner lid 46 into screw holes in supports 217. Two of mounting posts 220 are extended through inner lid 46 into screw holes in protrusion 215. Thus, inner lid 46 is fixed in space 200 of cover 20. Vertical section 470 of support 464 abuts two lateral walls of first groove 216 such that guide block 352 can not move in first groove 216 along a horizontal direction perpendicular to the vertical direction. Horizontal section 472 of support 464 abuts end faces of the lateral walls of first groove 216 such that guide block 352 can not move in the vertical direction.

According to the preferred form shown, the outer operational device further includes a returning device 28 having a body 296 having a non-circular outer periphery. Body 296 includes a lobe 300 on a lower end thereof and having rectangular cross sections. Body 296 further includes a compartment 298 in a side thereof. Compartment 298 forms an engaging groove 302 in lobe 300. A bottom wall defining compartment 298 includes a pivot hole 308. Two limiting blocks 304 are formed on the side of body 296 along a periphery of pivot hole 308. Each limiting block 304 includes an end 306. Furthermore, each limiting block 304 has a height to the side of body 296 smaller than or equal to a depth of compartment 298. A housing 282 slightly larger than body 296 is mounted to the side of body 296 to cover compartment 298. Housing 282 includes an axial hole 284 aligned with pivot hole 308.

According to the preferred form shown, returning device 28 further includes a substantially cylindrical rotatable member 280 having a flange 288 on an intermediate portion of an outer periphery thereof. Two pivotal sections 290 are formed on opposite sides of flange 288. Also formed on the outer periphery of rotatable member 280 are first and second blocks 286 adjacent two ends of flange 288. A slit 294 is formed between flange 288 and first block 286. Rotatable member 280 further includes a non-circular hole 292 through which engaging portion 244 of handle 24 extends. Pivotal sections 290 are respectively and pivotably received in pivot hole 308 of body 296 and axial hole 284 of housing 282 with blocks 286 located between limiting blocks 304. The spacing between limiting blocks 304 and blocks 286 limits rotation of rotatable member 280.

According to the preferred form shown, returning device 28 further includes an elastic element 312 in the form of a spiral spring having a spiral section, a first, outer tang 314 outside of the spiral section, and a second, inner tang 316 inside of the spiral section. The spiral section of elastic element 312 is mounted around limiting blocks 304 and located in compartment 298 with first, outer tang 314 abutting against a wall of engaging groove 302 and with second, inner tang 316 received in slit 294 of rotatable member 280 and abutting against a side of first block 286 adjacent slit 294. Thus, first tang 314 is fixed to body 296, and second tang 316 is fixed in slit 294. Rotatable member 280 is biased by elastic element 312 so that each of first and second blocks 286 presses against end 306 of one of limiting blocks 304. In this state, stem 240 of handle 24 is in a horizontal state with rotatable member 280 in its initial position. When rotatable member 280 is rotated, first block 286 adjacent slit 294 presses against second tang 316 of elastic element 312 to store the restoring force.

Returning device 28 is received in opening 462 of inner lid 46 and abuts against bend 466. Engaging portion 244 of handle 24 is extended through non-circular hole 292 of rotatable member 280. A fastener 250 is threadedly engaged in a screw hole in an end face of engaging portion 244 and includes a head abutting against rotatable member 280, such that returning device 28 can not move along engaging portion 244. Thus, follower 38 and actuating member 36 are retained in place. Due to non-circular coupling between engaging portion 244 and rotatable member 280, elastic element 312 is twisted by rotatable member 280 when handle 24 is rotated. When handle 24 is released, elastic element 312 returns rotatable member 280 to its initial position and returns handle 24 to its initial, horizontal position. Limiting blocks 304 limit rotational movement of handle 24 to be about 45° in either direction. According to the preferred form shown, handle 24 can rotate 45° in a counterclockwise direction.

According to the preferred form shown, the outer operational device further includes a limiting member 32 including a substantially triangular pivotal portion 320. Pivotal portion 320 includes first and second limiting portions 322 and 336 with a groove 338 formed between first and second limiting portions 322 and 336. A stop 324 is formed on a side of pivotal portion 320. Stop 324 has a positioning hole 328 in a face thereof. Stop 324 further includes an arcuate stop face 334 facing first limiting portion 322. Further, stop 324 includes a follower portion 326 on an upper end thereof. Follower portion 326 includes first and second protruded portion 330 and 332.

According to the preferred form shown, the outer operational device further includes first and second guide pins 346 and 347 mounted in upper and lower fixing holes 210 of cover 20. Pivotal portion 320 of limiting member 32 is pivotably mounted around second guide pin 347. First guide pin 346 is slideably received in groove 338 between first and second limiting portions 322 and 336. A spring 354 includes a first tang 356 received in positioning hole 212 of cover 20 and a second tang 358 received in positioning hole 328 of stop 324.

Figure 11:
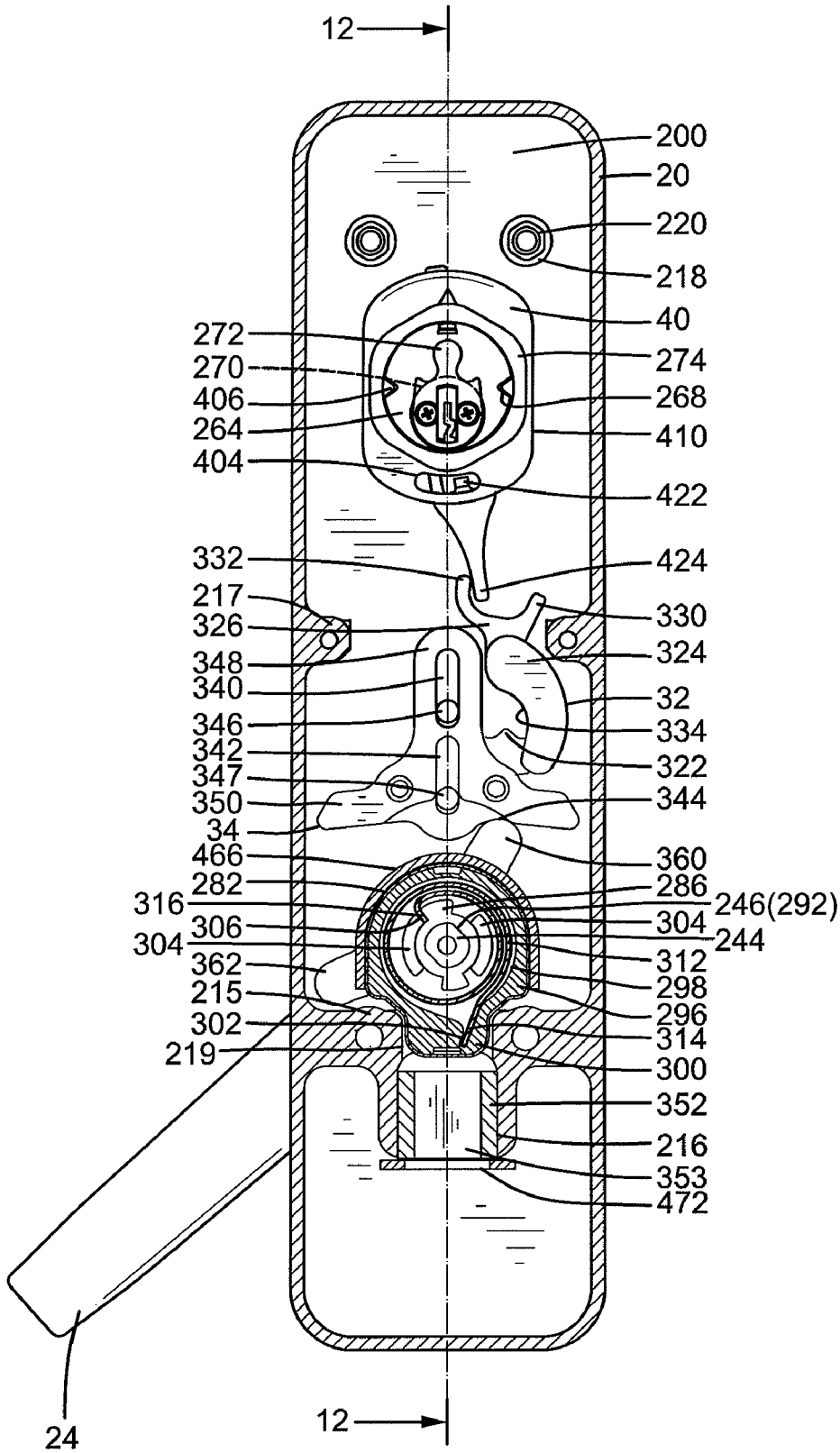
FIG. 11 is a view similar to FIG. 5 with a handle operated for unlocking purposes.

According to the preferred form shown, the outer operational device further includes a substantially T-shaped sliding member 34 having a vertical first section 348 and a substantially horizontal second section 350. First section 348 includes a first guiding groove 340 and a second guide groove 342 below first guiding groove 340. Each of first and second guiding grooves 340 and 342 has a length substantially the same as that of elongated slots 460 of inner lid 46. Second section 350 includes a connecting portion 341 having two pegs 349 each having a screw hole. Furthermore, second section 350 includes a pressing face 344 at a lower end thereof. Sliding member 34 is slideably received in space 200 of cover 20 with pressing face 344 abutting against first and second ends 360 and 362 of actuating member 36. First guide pin 346 is extended through first guiding groove 340, and second guide pin 347 is extended through second guiding groove 342, so that limiting member 34 can only slide through the length of first and second guiding grooves 340 and 342 in the vertical direction. Pegs 349 of connecting portion 341 are extended into elongated slots 460 of inner lid 40. Provision of first and second guiding grooves 340 and 342 prevent rotation of sliding member 34 during sliding movement. When rotatable member 280 rotates to a position abutting against the other limiting block 304, actuating member 36 rotates, with one of first and second ends 360 and 362 (depending on the rotating direction of actuating member 36) pushes sliding member 34 upward to an upper position (FIG. 11). When first and second ends 360 and 362 of actuating member 36 are at the same level, sliding member 34 is in its lower position.

According to the preferred form shown, the outer operational device further includes a substantially T-shaped driving member 44 having a base portion 440 extending in the vertical direction and a rod 442 extending horizontally from an intermediate section of base portion 440. An upper end of base portion 440 is bent to form an engaging portion 448. A lower end of base portion 440 includes a guiding portion 444 that has a shape corresponding to sliding groove 353 of guide block 352 and that is aligned with connecting portion 341 of sliding member 34. Two fasteners 446 are extended through holes in engaging portion 448 and elongated slots 460 of inner lid 46 into the screw holes of pegs 349 of connecting portion 341 of sliding member 34. Guiding portion 444 is extended into sliding groove 353 of guide block 35. Thus, driving member 44 and sliding member 34 can move jointly. Elongated slots 460 of inner lid 46 allow movement of fasteners 446. Sliding groove 353 allows stable sliding of guiding portion 444 when rod 442 is subjected to a torque. Rod 442 extends through mounting hole 106 of door 10 and slot 146 of base 144 of follower device 16 to a position below a lower one of slides 142.

According to the preferred form shown, the outer operational device further includes a cylinder 26 including a cylindrical body 264 having a flange 262 on an end face thereof. A front end of an outer periphery of body 264 includes a threaded portion 266. The outer periphery of body 264 further includes two diametrically opposed V-shaped positioning grooves 268. A lock core 270 is received in body 264. An actuator 272 is provided on the other end face of body 264 and fixed to lock core 270 to rotate therewith. Cylinder 26 is received in compartment 206 of cover 20 with flange 262 abutting a bottom wall of compartment 206. Body 264 is extended through opening 208 into mounting hole 106 of door 10.

According to the preferred form shown, the outer operational device further includes a mover 42 having a circular hole 420. Mover 42 includes a limiting bar 426 extending upward from an upper end thereof and an actuating bar 424 extending downward from a lower end thereof. A tab 422 extends perpendicularly from actuating bar 424. Mover 42 is rotatably mounted around body 264.

According to the preferred form shown, the outer operational device further includes a lid 40 in the form of a thin shell. Specifically, lid 40 includes two lateral walls 410 and an interconnecting wall 412 interconnected between lateral walls 410. A hole 402 is defined in interconnecting wall 412 and has a shape corresponding to body 264 of cylinder 26. Two diametrically opposed projections 406 are formed on an inner periphery of hole 402. Interconnecting wall 412 further includes an arcuate limiting groove 404 below hole 402. Lid 40 further includes an upper notch 408 in a top thereof between upper ends of lateral walls 410 and a lower notch 408 in a bottom thereof between lower ends of lateral walls 410. Lid 40 is mounted around body 264 of cylinder 26 with projections 406 engaged in positioning grooves 268 and with lateral walls 410 abutting chamfered faces 209 of receiving portion 205, so that cylinder 26 can not rotate and that lid 40 can not rotate relative to receiving portion 205. A washer 274 with inner threading is threadedly engaged around threaded portion 266 and abuts a face of interconnecting wall 412 of lid 40, preventing lid 40 from moving along an axial direction of body 264. Furthermore, mover 42 is rotatably mounted between cover 20 and washer 274.

Limiting bar 426 of mover 42 extends beyond upper notch 408 of lid 40, and actuating bar 424 extends beyond lower notch 408 of lid 40. Furthermore, tab 422 of mover 42 extends beyond limiting groove 404 of lid 40. Thus, rotational movement of mover 42 is limited by notches 408 and limiting groove 404. Actuating bar 424 is located between first and second protruded portions 330 and 332 of limiting member 32. Tab 422 is located in a path of rotational movement of actuator 272 of cylinder 26, so that mover 42 rotates when actuator 272 comes in contact with and drives tab 422.

Figure 2:
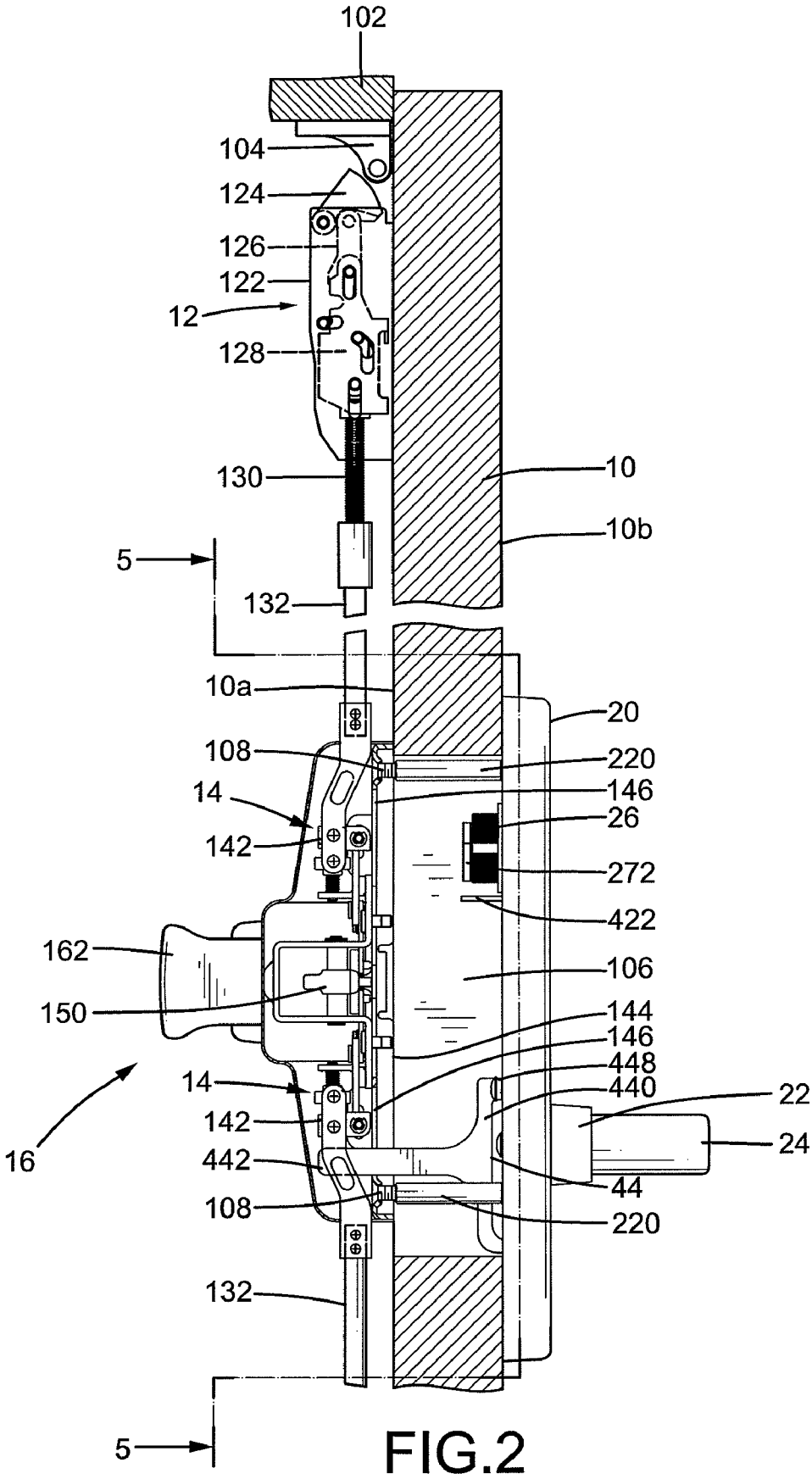
FIG. 2 shows a cross sectional view according to section line 2-2 of FIG. 1 with the lock in a locked state.
Figure 3:
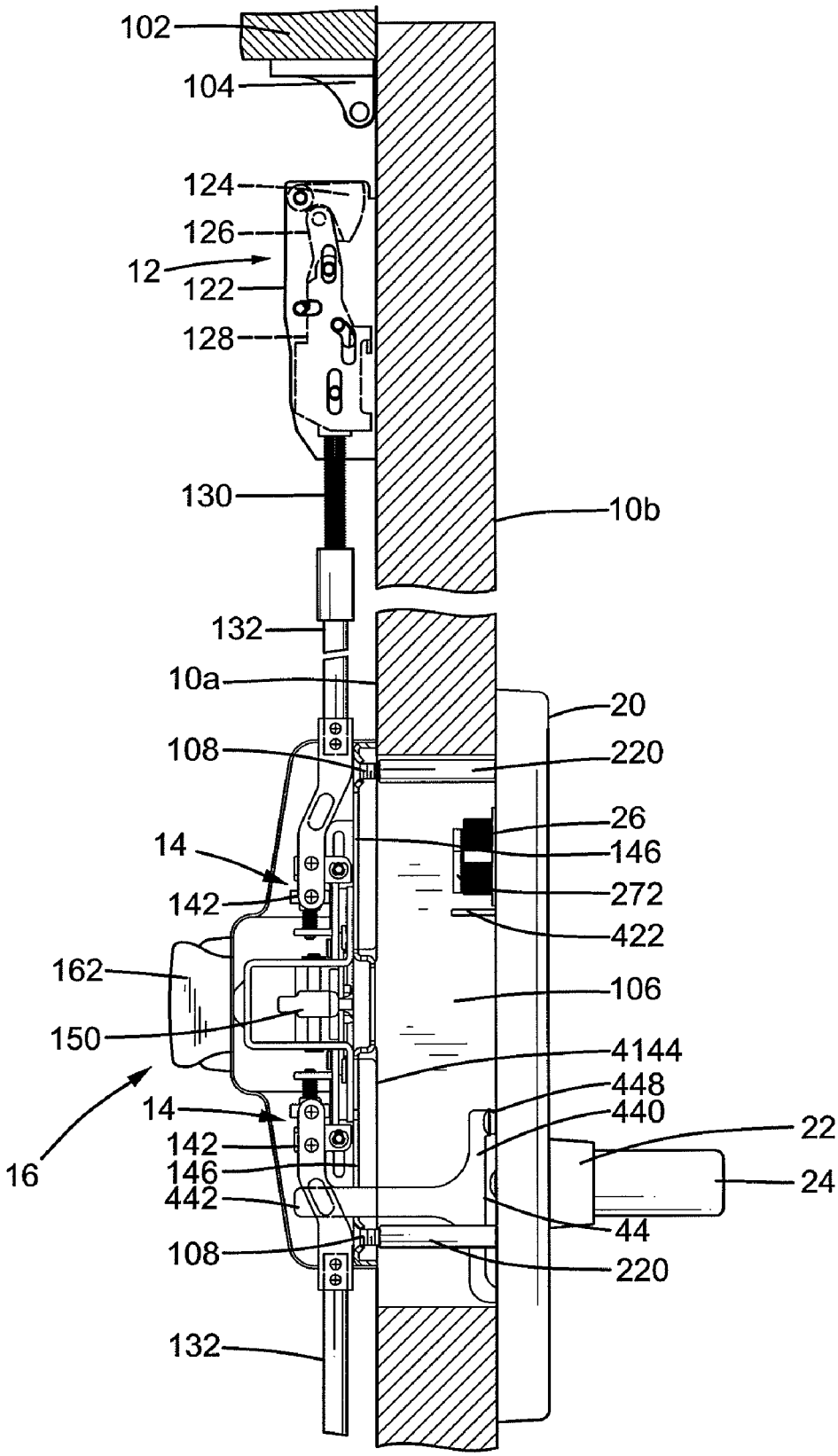
FIG. 3 is a view similar to FIG. 2, with a follower device operated for unlocking purposes.
Figure 4:
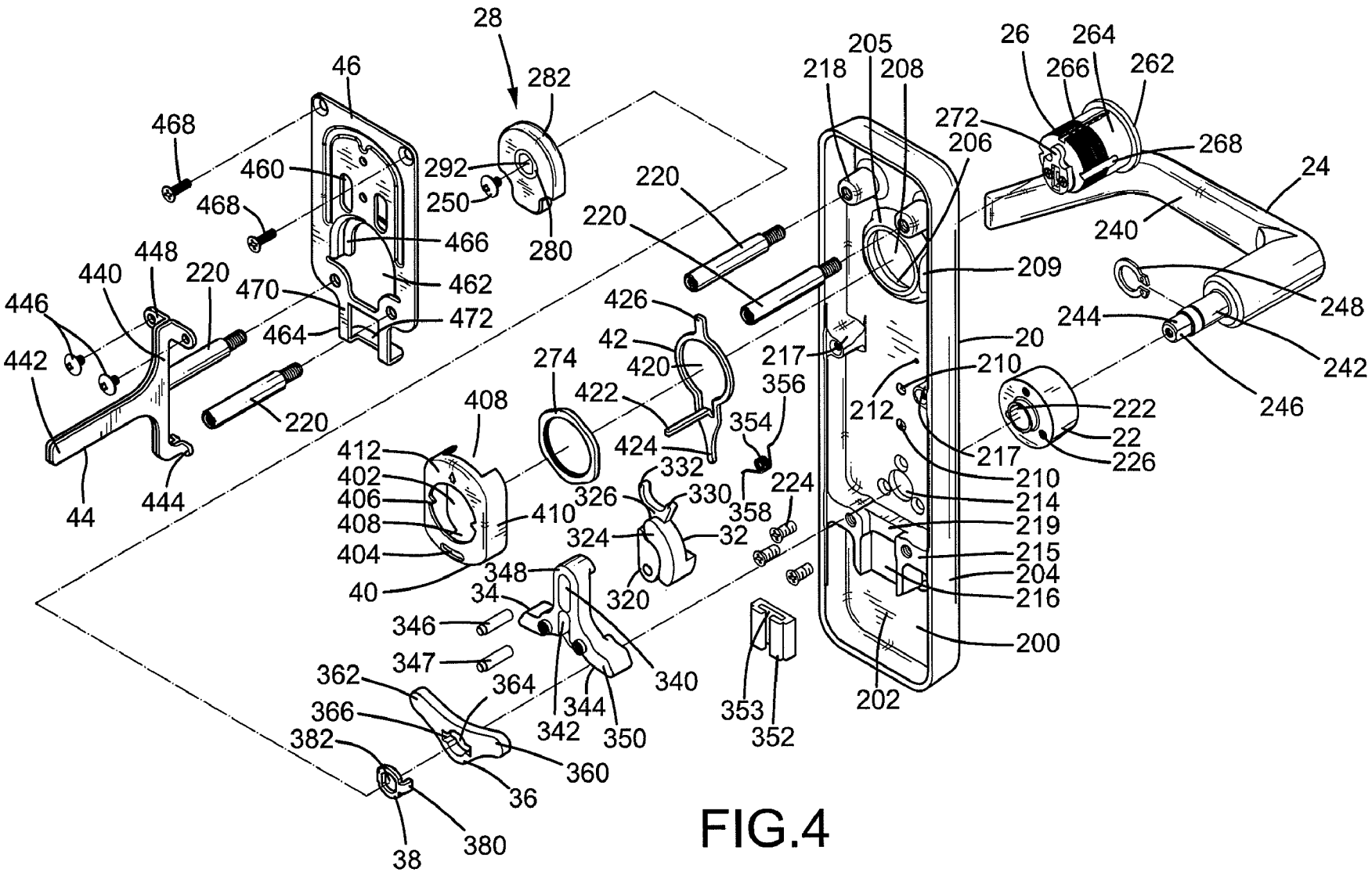
FIG. 4 shows a partial, exploded, perspective view of the outer operational device of FIG. 1.
Figure 5:
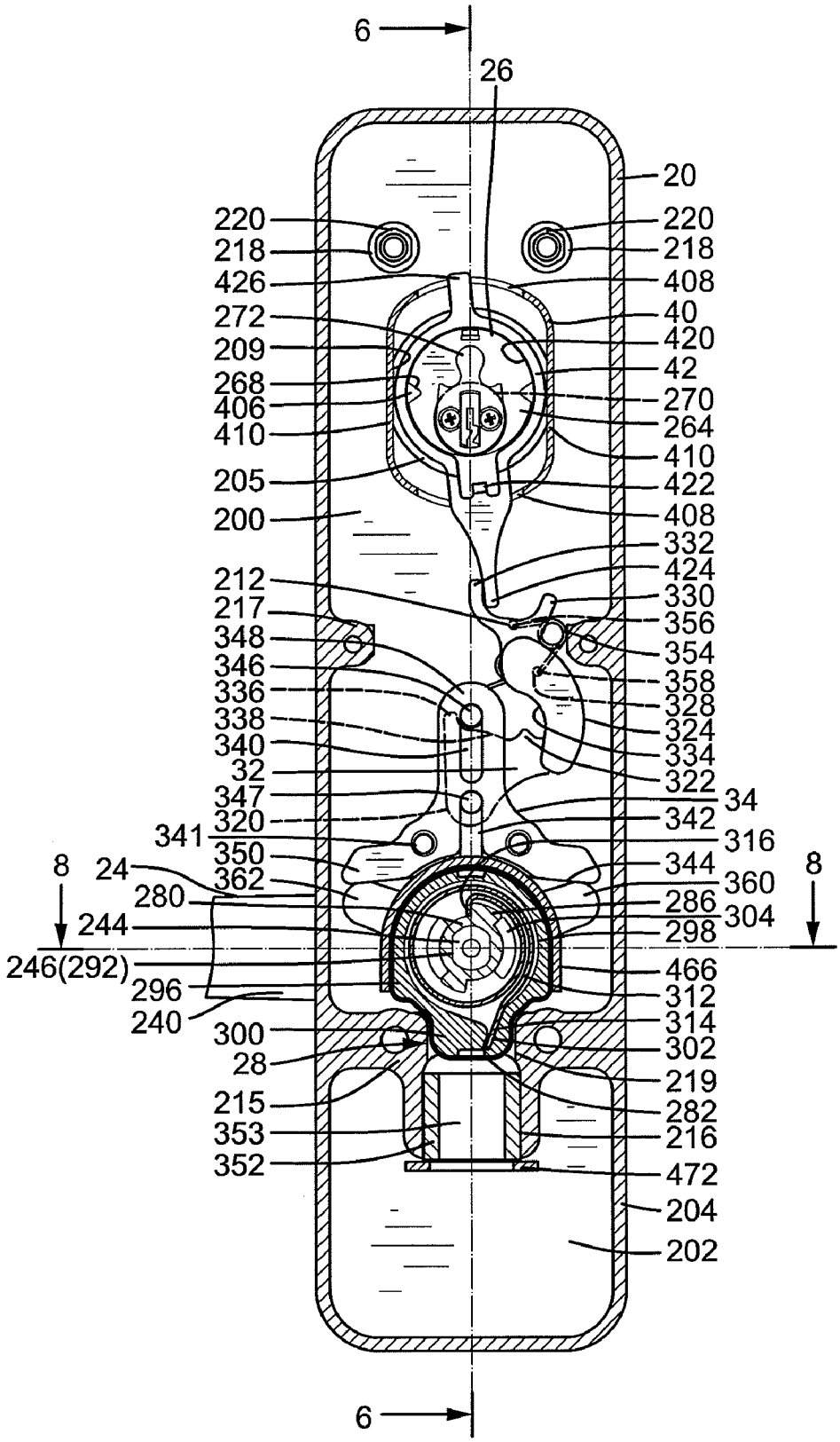
FIG. 5 shows a cross sectional view according to section line 5-5 of FIG. 2.
Figure 6:
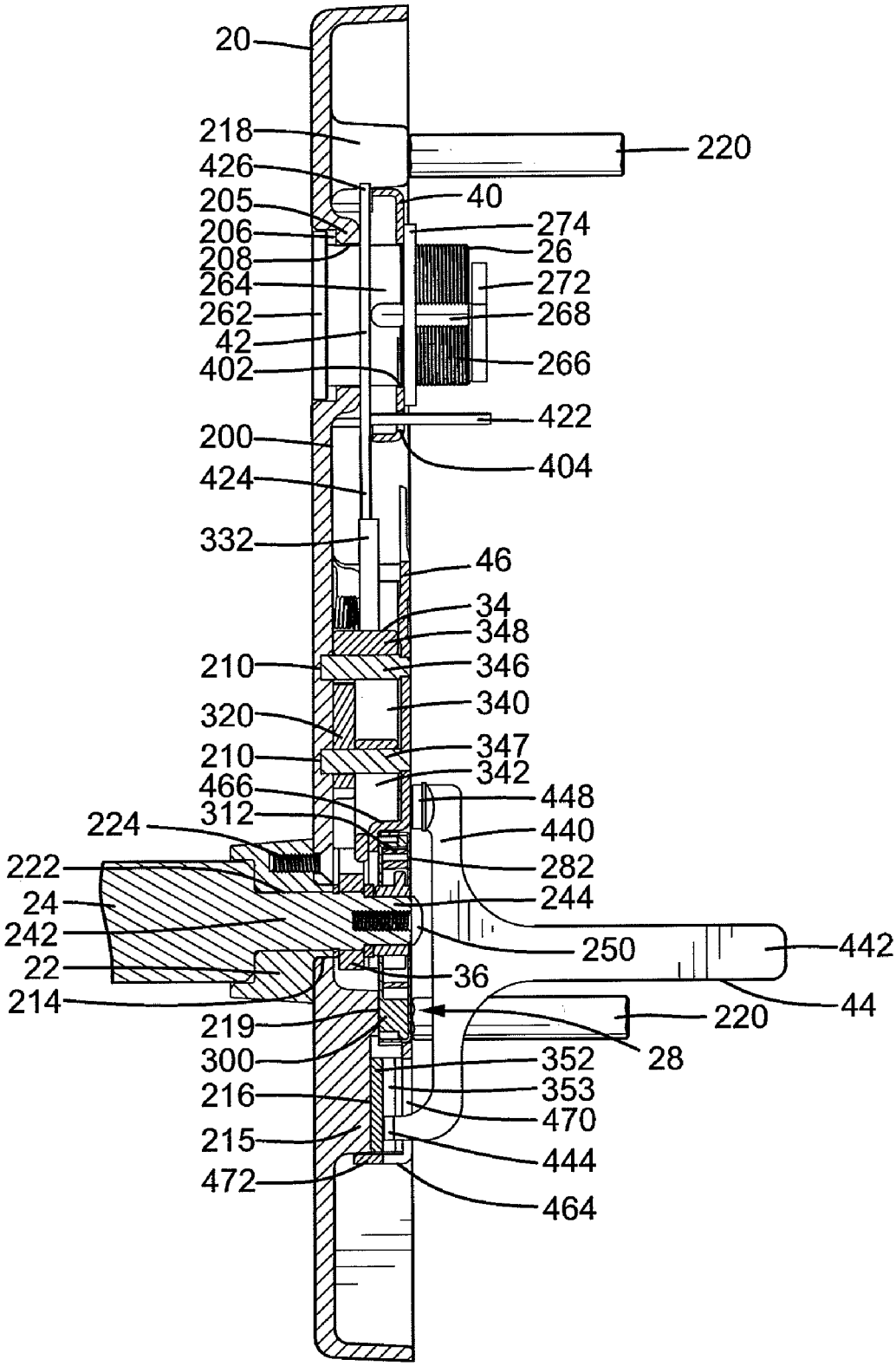
FIG. 6 shows a cross sectional view according to section line 6-6 of FIG. 5.
Figure 7:
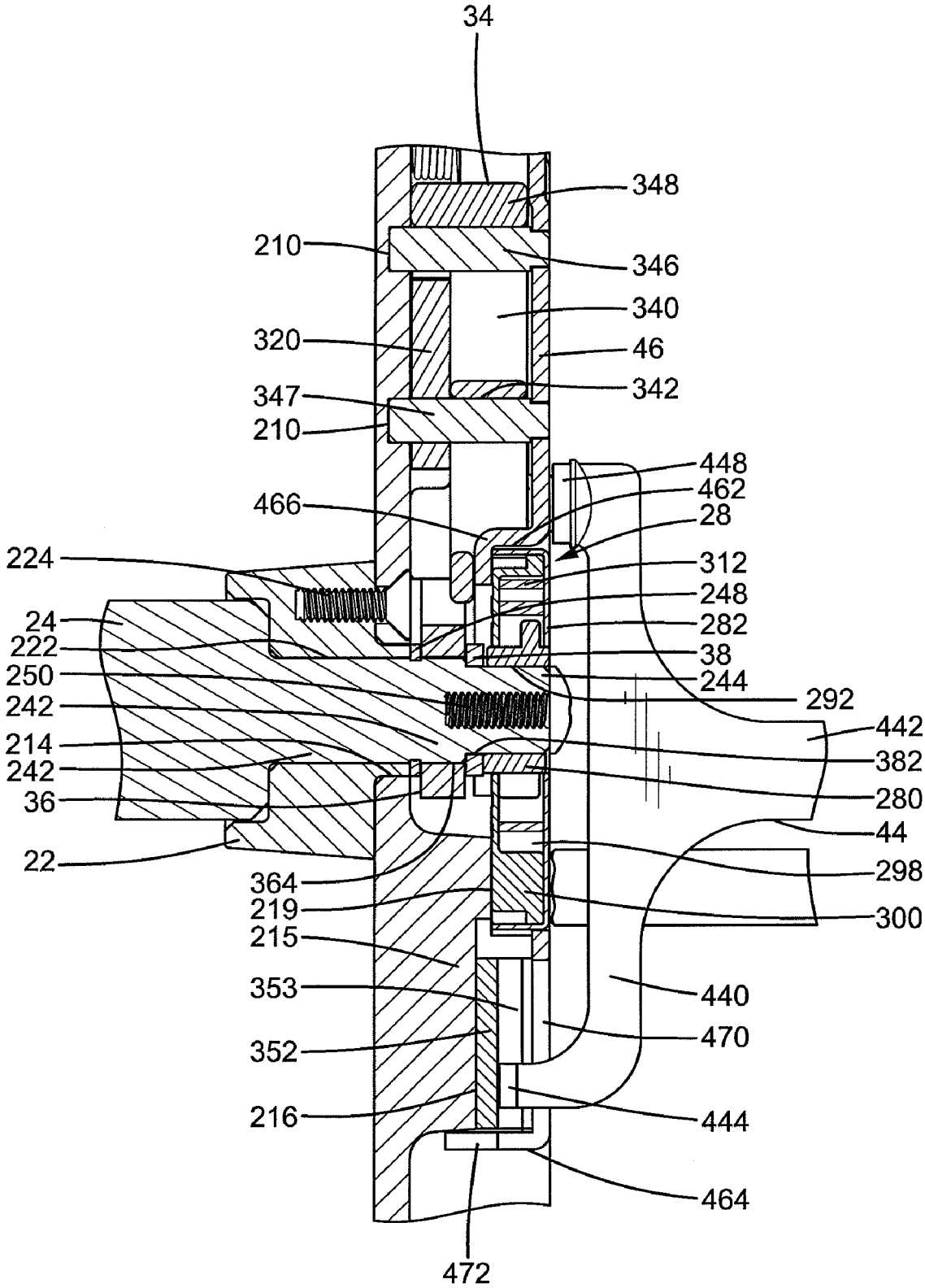
FIG. 7 shows a partial, enlarged view of the outer operational device of FIG. 6.
Figure 8:
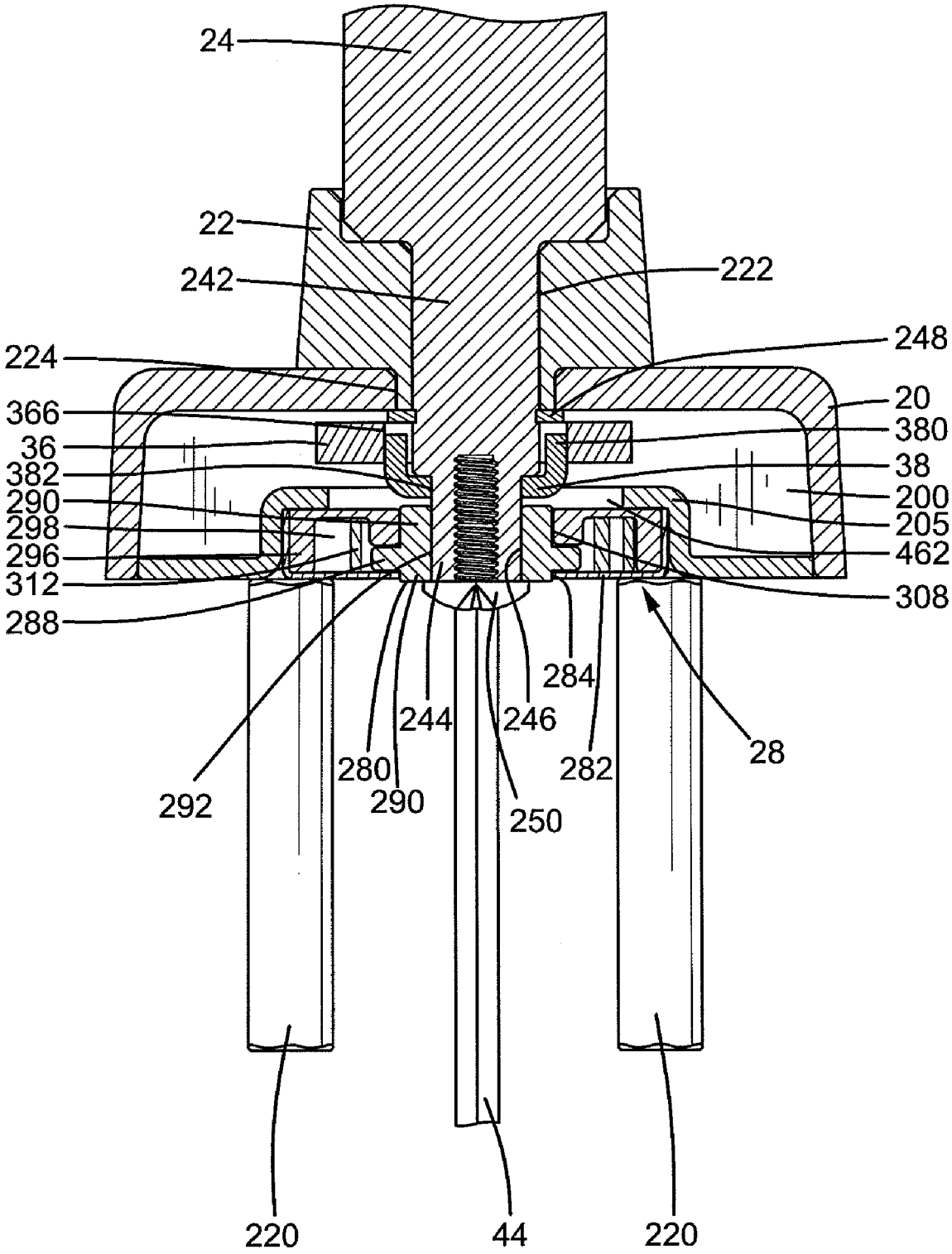
FIG. 8 shows a cross sectional view according to section line 8-8 of FIG. 5.
Figure 9:
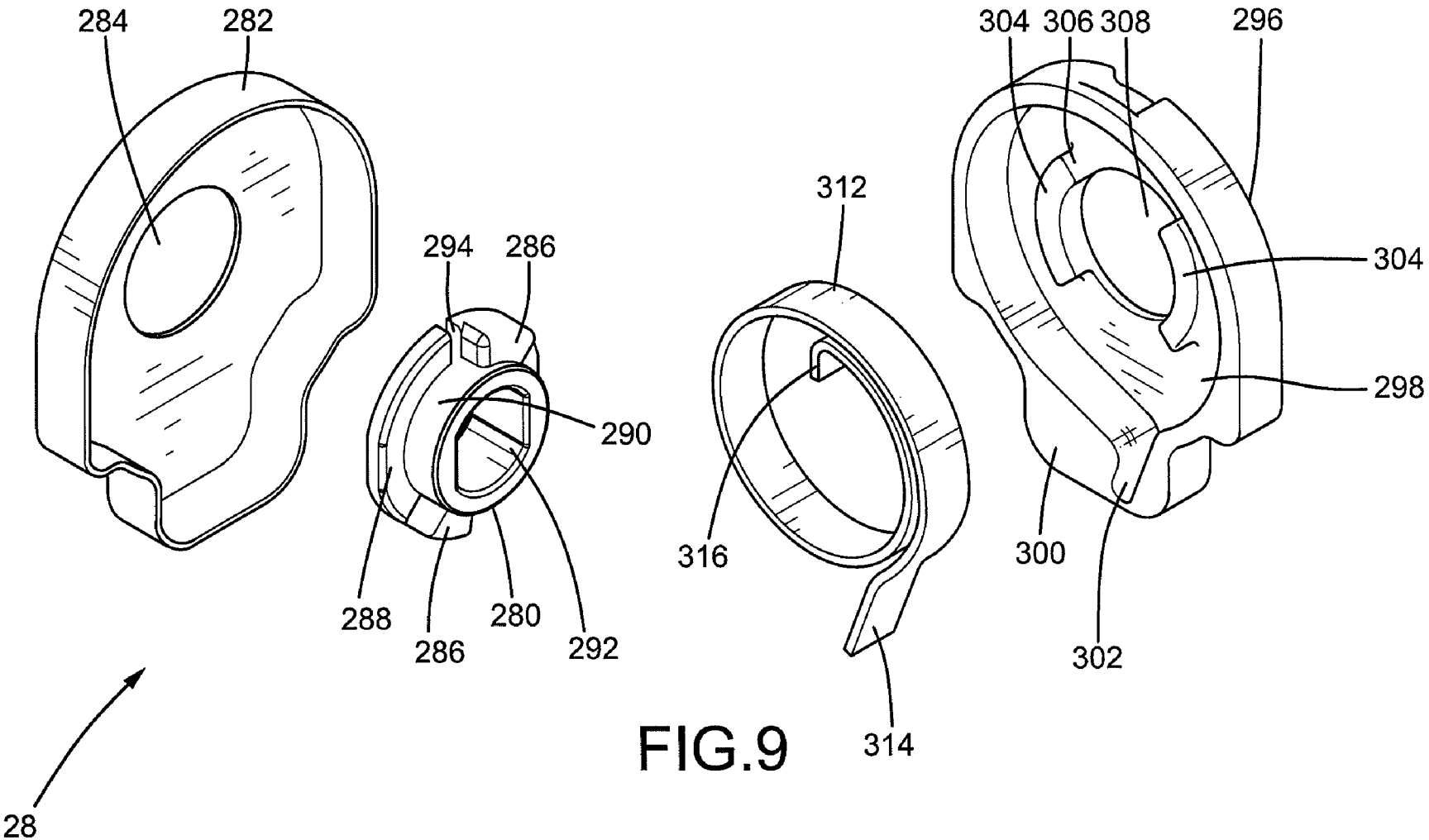
FIG. 9 shows an exploded, perspective view of a returning device of the outer operational device of FIG. 1.
Figure 10:
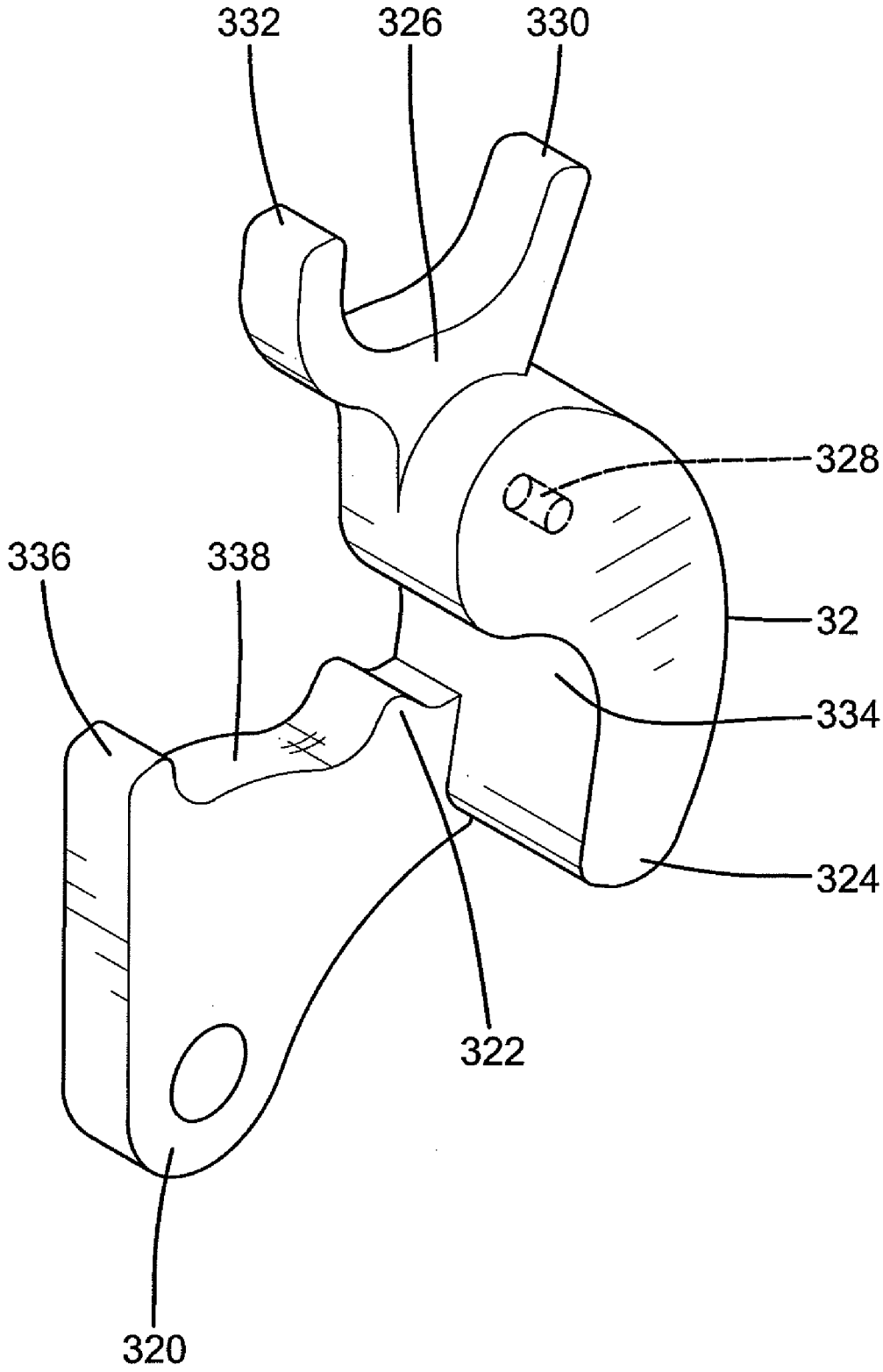
FIG. 10 shows an enlarged, perspective view of a limiting member of the outer operational device of FIG. 1.
Figure 12:
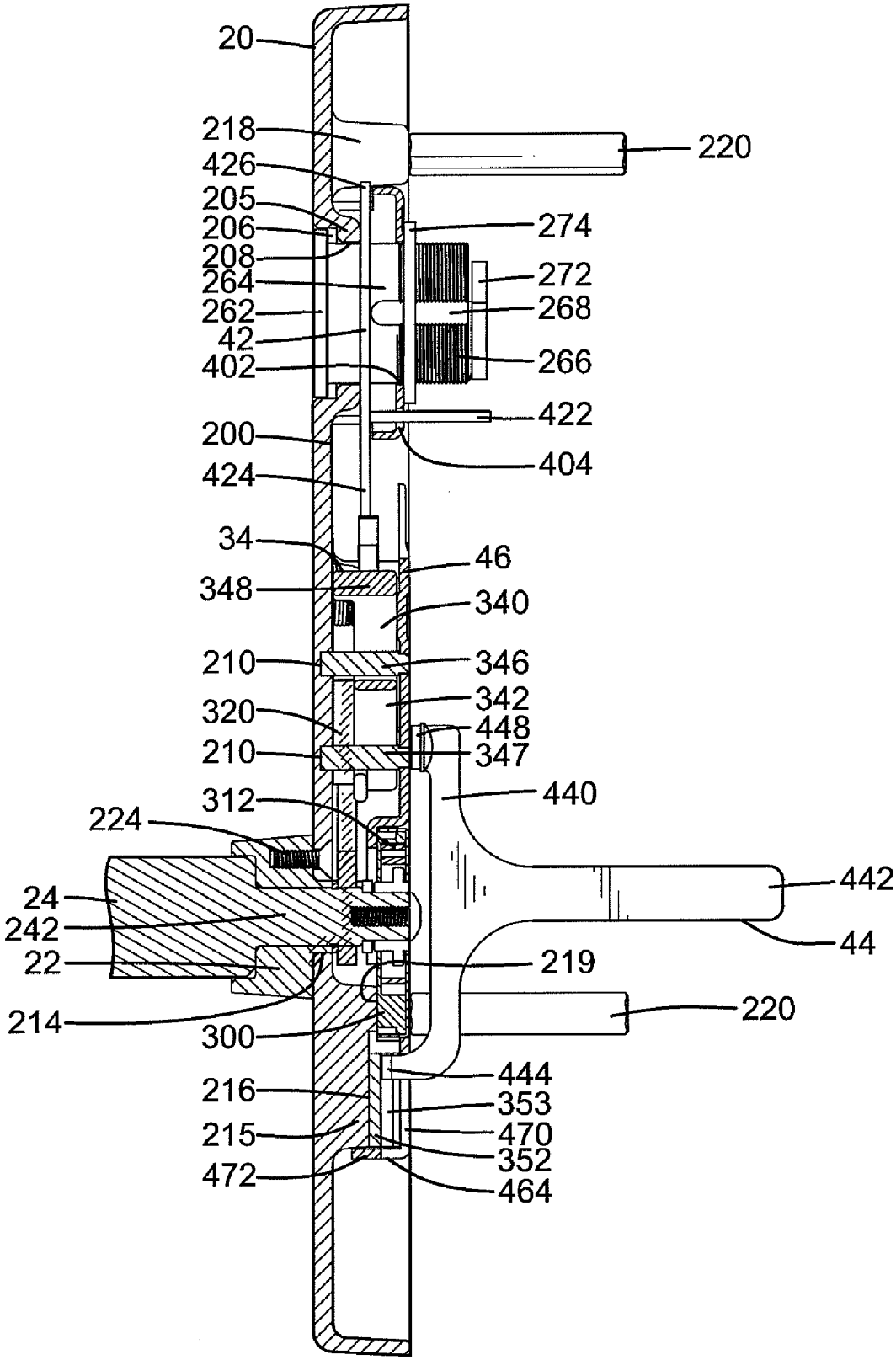
FIG. 12 shows a cross sectional view according to section line 12-12 of FIG. 11.
Figure 13:
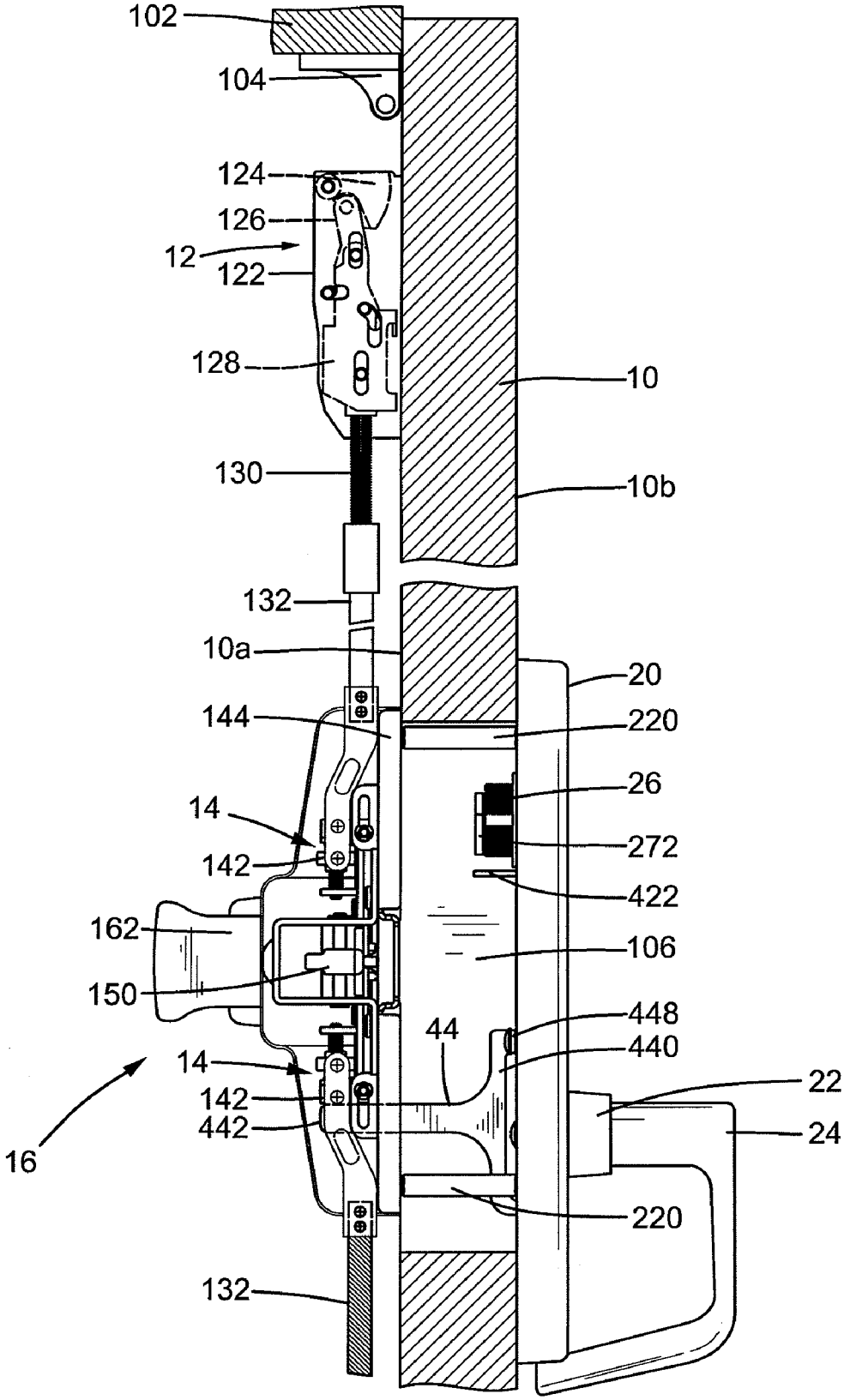
FIG. 13 is a view similar to FIG. 2 with the handle operated for unlocking purposes.

Now that the basic construction of the outer operational device of the preferred teachings of the present invention has been explained, the operation and some of the advantages of the outer operational device can be set forth and appreciated. In particular, for the sake of explanation, it will be assumed that handle 24 is in a horizontal position (FIGS. 2, 5, and 6). When handle 24 is rotated, follower 38 and rotatable member 280 of returning device 28 rotate jointly with engaging portion 244, so that first block 286 moves second tang 316 of elastic element 312 and that elastic element 312 is twisted to store potential energy for returning purposes. Actuating member 36 is driven by follower 38 to rotate in a direction (see FIG. 11). When handle 24 is rotated counterclockwise, first end 360 of actuating member 36 rotates upward whereas second end 362 of actuating member 36 rotates downward. First end 360 of actuating member 36 presses against pressing face 344 of sliding member 34, so that sliding member 34 move upward along first and second guide pins 346 and 347. At the same time, driving member 44 is carried upward by sliding member 34. When first block 286 is rotated from its initial position to an extreme position abutting against end 306 of the other limiting block 304, driving member 44 is moved from the lower position to the upper position where stem 240 of handle 24 is at an angle of 45° with the horizontal plane (FIGS. 11-13).

During movement of driving member 44 from the lower position to the upper position, lower slide 142 of follower device 16 is pressed against and, thus, moved by rod 442 of mover 42. Slides 142 pull coupling rods 132 and screw rods 130 in the vertical direction, which in turn, move followers 128 and connecting rods 16 to pivot latches 124 to the unlocking positions (FIG. 13), allowing opening of door 10.

When handle 24 is released after unlocking, second tang 316 of elastic element 312 returns rotatable member 280 from the extreme position back to the initial position, which in turn, rotates handle 24 in a clockwise direction in FIG. 11 to its initial position via engaging portion 244. Thus, stem 240 of handle 24 returns to its horizontal position, and first and second ends 360 and 362 of actuating member 36 are at the same level. At the same time, sliding member 34 moves downward under the action of gravitational force until first and second ends 360 and 362 of actuating member 36 simultaneously abut pressing face 344. Furthermore, driving member 44 is carried by sliding member 34 to the lower position. Slides 142 of follower device 16 are returned by a returning device of latch device 12 to positions shown in FIG. 5.

It can be appreciated that limiting member 32 provides the outer operational device according to the preferred teachings of the present invention with a burglarproof function through a setting operation. Specifically, when the burglarproof function is not set, limiting member 32 is biased by spring 354 to a release position away from sliding member 34. In this case, second limiting portion 336 abuts against first guide pin 346, actuating bar 424 of mover 42 abuts against second protruded portion 332 of limiting member 32, handle 24 is in the horizontal state, and sliding member 34 is in the lower position.

Figure 14:
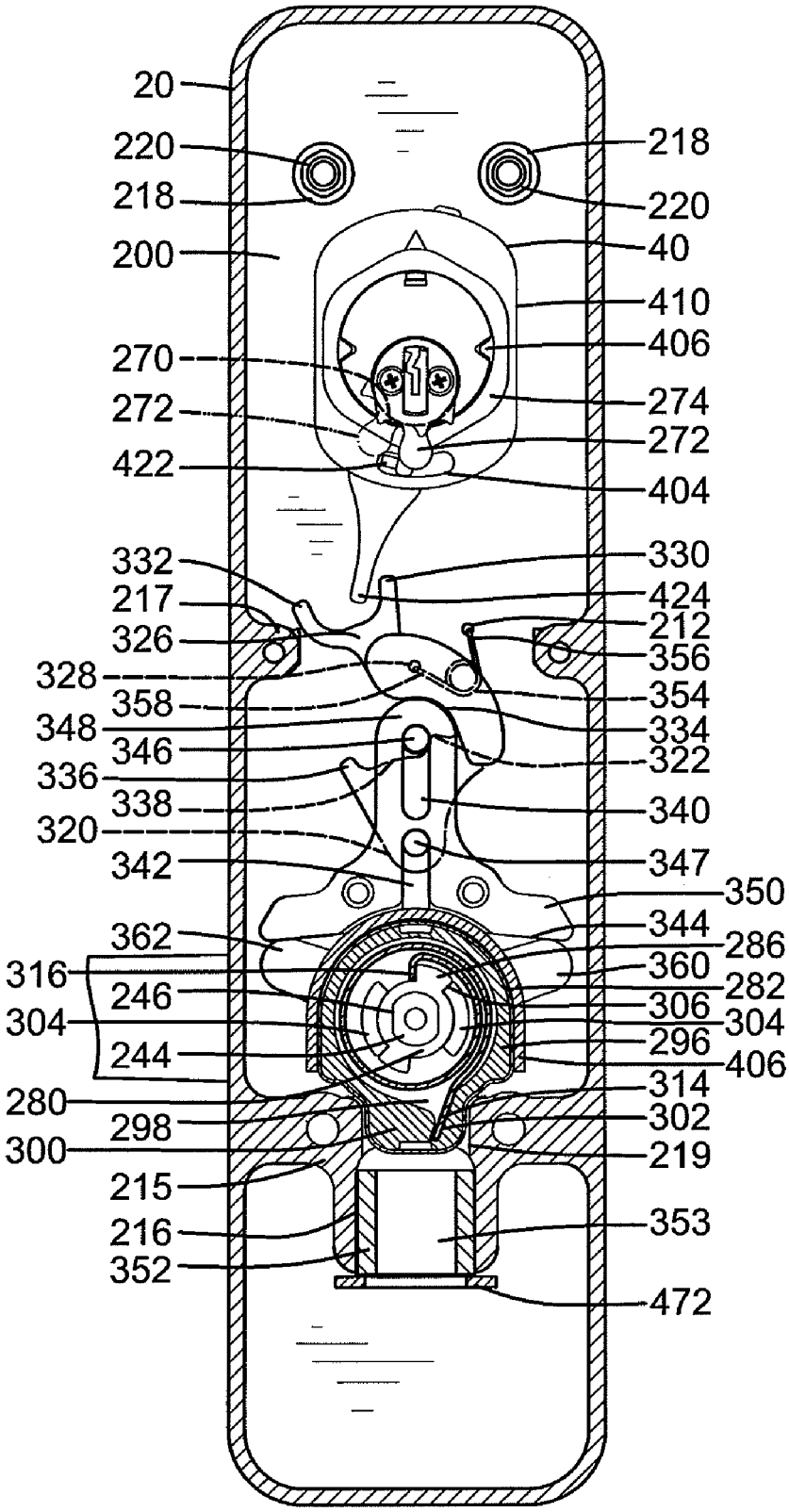
FIG. 14 is a view similar to FIG. 5 with the limiting member operated to provide a burglarproof function.

To set the burglarproof function, a key is inserted into lock core 270 in cylinder 26 to unlock and rotate lock core 270, so that actuator 272 is rotated to press against tab 422 of mover 42 in a clockwise direction in FIG. 5. Tab 422 of mover 42 pushes second protruded portion 332 of limiting member 32 so that stop 324 of limiting member 32 rotates toward first section 348 of sliding member 34 until stop 324 abuts on top of first section 348 of sliding member 34. In this case, limiting member 32 is in a blocking position (FIG. 14). Furthermore, when limiting member 32 rotates, second tang 358 of spring 354 rotates about a pivot axis defined by first tang 356 to a position retaining limiting member 32 in the blocking position. Movement of sliding member 34 is blocked by limiting member 32 so that actuating member 36 and follower 38 can not rotate. Thus, handle 24 can not be rotated. In this state, unlocking can not be achieved through operation of handle 24. A burglarproof function is, thus, provided.

When it is desired to remove the burglarproof setting, the key is inserted into lock core 270 in cylinder 26 to rotate lock core 270, so that actuator 272 is rotated to press against tab 422 of mover 42 in a counterclockwise direction. Tab 422 of mover 42 pushes first protruded portion 330 of limiting member 32 so that limiting member 32 rotates clockwise. At the same time, second tang 358 of spring 354 is pulled and rotates about the pivot axis defined by first tang 356, such that spring 354 returns to a position retaining limiting member 32 in the release position (FIG. 5). Movement of sliding member 34 is no longer blocked by limiting member 32 so that actuating member 36 and follower 38 can rotate. Thus, handle 24 can be rotated for unlocking purposes.

Figure 15:
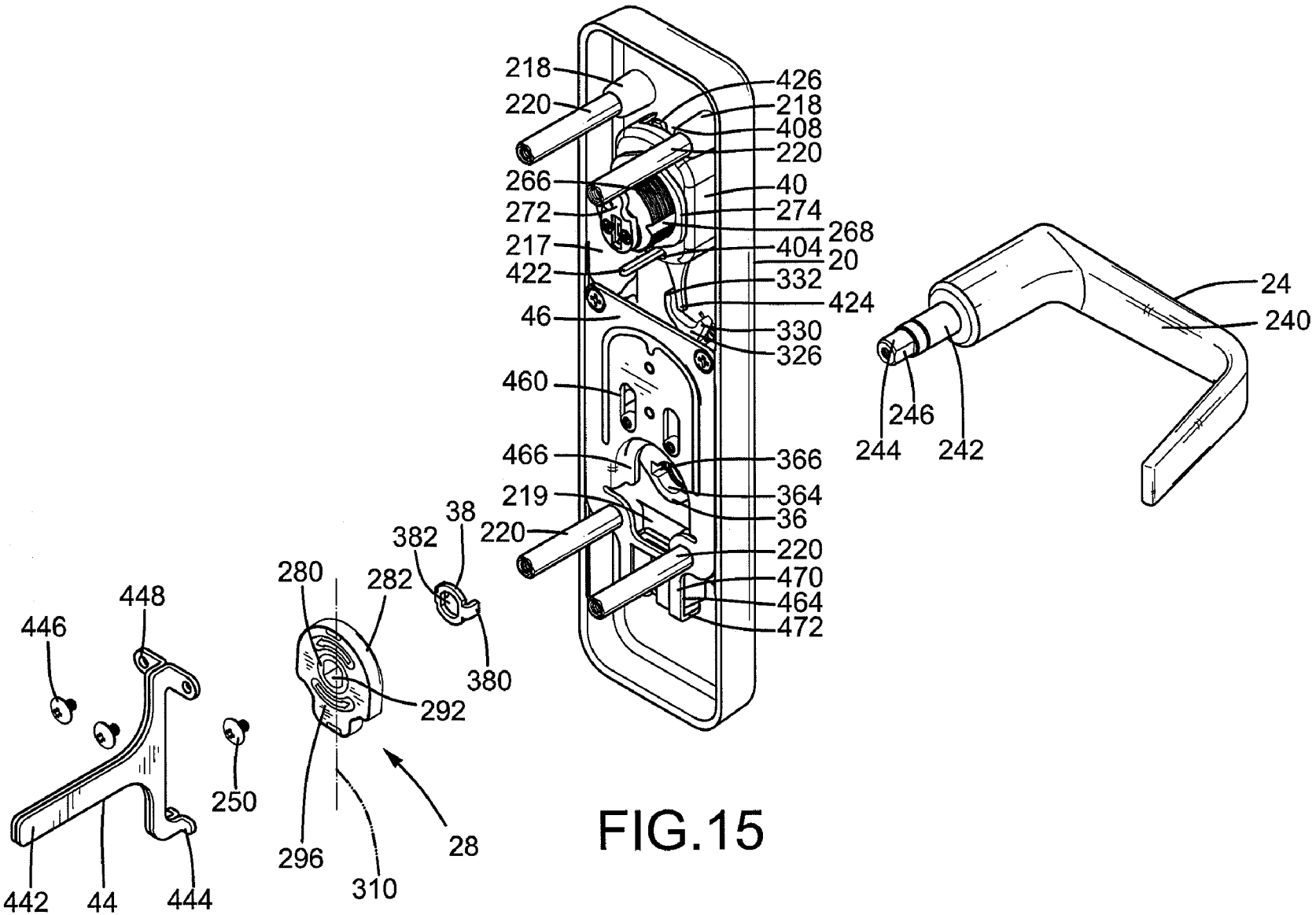
FIG. 15 is an exploded, perspective view showing mounting of the outer operational device according to the preferred teachings of the present invention to a left-handed door.
Figure 16:
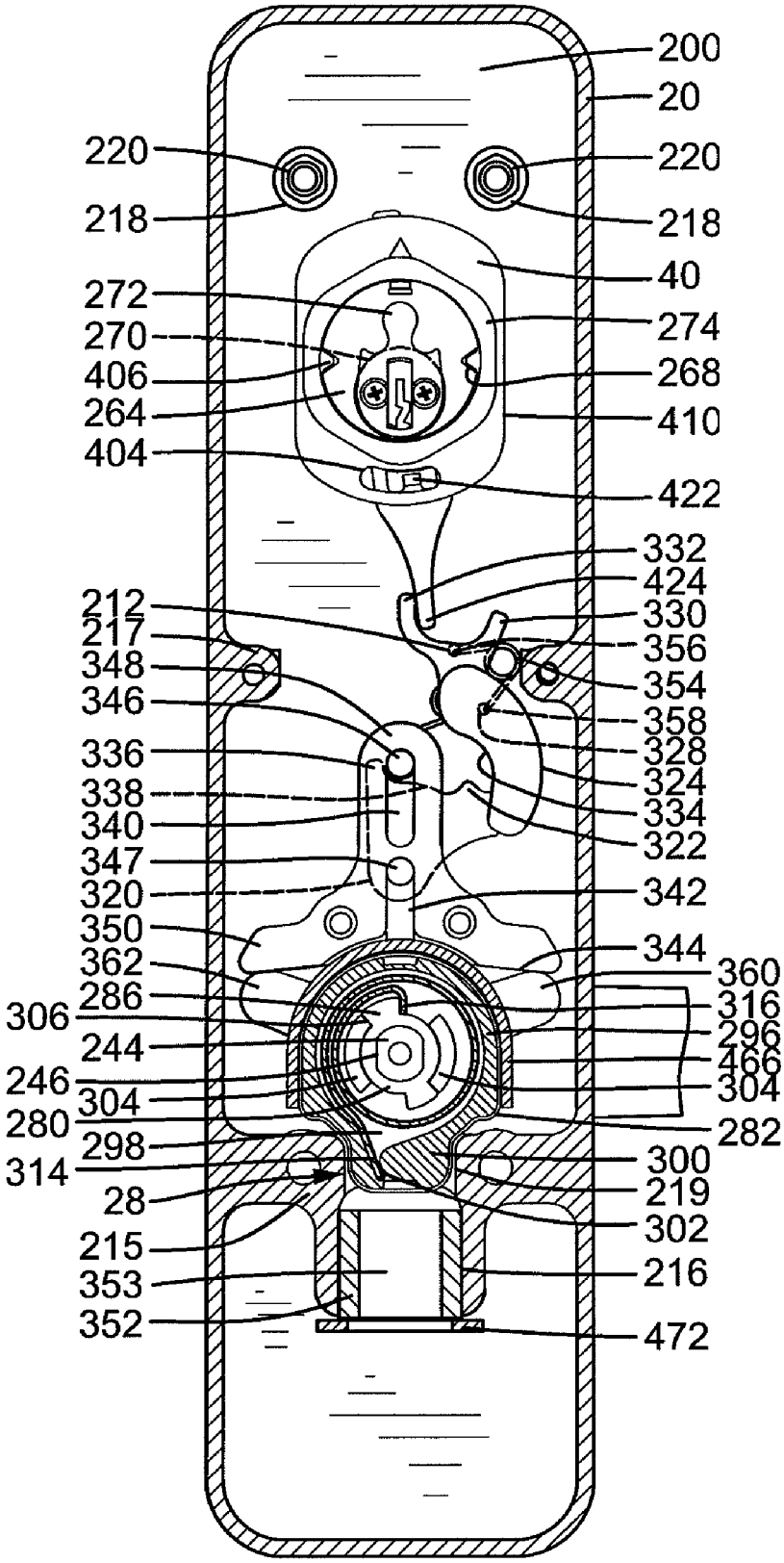
FIG. 16 shows a cross sectional view of the outer operational device of FIG. 15.

Furthermore, the outer operational device according to the preferred teachings of the present invention allows easy replacement of handle so that it can be mounted to either a right-handed door or a left-handed door through simple operation. Specifically, door 10 shown in FIG. 1 is a right-handed door, and handle 24 is rotated counterclockwise for unlocking purposes. With reference to FIG. 15, when it is desired to mount the outer operational device according to the preferred teachings of the present invention on a left-handed door, driving member 44 is removed and then fastener 250. Returning device 28 and follower 38 are then removed from engaging portion 244 of handle 24. Handle 24 is rotated 180° (FIG. 16). Note that other elements are not actuated, for actuating member 36 rotates freely on handle 24. After mounting follower 38 on engaging portion 244 of handle 24, returning device 28 is mounted back onto engaging portion 244 of handle 24 after being rotated 180° about an axis 310 (FIG. 15), with housing 282 located behind body 296 (housing 282 is in front of body 296 when utilized with a right-handed door). Then, fastener 250 is screwed into engaging portion 244 to fix returning device 28 in place, and driving member 44 is fixed to sliding member 34. Thus, the outer operational device according to the preferred teachings of the present invention is mounted to a left-handed door. The operational procedure is simple and can be rapidly carried out on the site.

Since follower 38 acts as a medium for driving actuating member 36 when handle 24 is rotated, teeth 380 of follower 38 break when an excessive force is applied to handle 24. Thus, handle 24 rotates freely to avoid damage to the outer operational device according to the preferred teachings of the present invention and other components of the lock.

Now that the basic teachings of the present invention have been explained, many extensions and variations will be obvious to one having ordinary skill in the art. For example, although follower device 16 shown in the preferred form is utilized with top and bottom latches, the outer operational device according to the preferred teachings of the present invention can be utilized with follower device 16 having a latch itself. Furthermore, one of teeth 380 of follower 380 can be omitted. Further, actuating member 36 can be operated with only one end 360 or 362. In this case, actuating member 36 can be rotated 180° when mounted to a differently handed door.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. An outer operational device for a panic exit door lock, comprising, in combination:

a cover adapted to be mounted to a side of a door, with the cover defining a space, with the cover including a sidewall extending in a vertical direction and an annular wall extending perpendicularly along a periphery of sidewall, with the space defined between the annular wall and the sidewall;

a handle including a shank having an engaging portion with non-circular cross sections, with the shank rotatably received in the cover;

an actuating member mounted in the space and including an end and a non-circular connecting hole engaged with the engaging portion to rotate therewith;

a sliding member slideably received in the space, with the sliding member including a pressing face abutting against the end of the actuating member, so that the sliding member slides when the actuating member rotates;

a limiting member pivotably received in the space, with the limiting member including a pivotal portion and a stop, with the stop including a follower portion, with the limiting member being pivotable between a blocking position not allowing movement of the sliding member and a release position allowing movement of the sliding member, with the handle being rotatable when the limiting member is in the release position, with the handle being not rotatable when the limiting member is in the blocking position;

a driving member fixed to the sliding member to move therewith, with the driving member including a rod adapted to couple with a panic exit door lock mounted to another side of the door, with the rod being movable to control locking or unlocking of the panic exit door lock;

a cylinder mounted to the cover and including a lock core rotatably mounted therein, with an actuator being mounted outside of the cylinder and fixed to the lock core to rotate therewith;

a mover rotatably mounted around the cylinder and including a tab and an actuating bar, with the tab being located in a path of rotational movement of the actuator and, thus, operably connected to the actuator, with the actuating bar being operably connected to follower portion, such that the mover is rotated to move the limiting member between the blocking position and the release position when the actuator is rotated; and a returning device mounted in the space and including:

a body including a compartment;

a housing mounted around the body;

a rotatable member rotatably mounted in the compartment, with the rotatable member including a non-circular hole engaged with the engaging portion to allow joint rotation of the rotatable member and the handle; and an elastic element mounted between the body and the rotatable member for returning the rotatable member and the handle.

2. The outer operational device as claimed in claim 1, further comprising, in combination: a follower including a non-circular hole engaged with the engaging portion of the handle to allow joint rotation of the follower and the handle, with the follower including a first tooth on an outer periphery thereof, with the actuating member including a first groove in an inner periphery of the non-circular connecting hole, and with the first tooth engaged in the first groove to allow joint rotation of the handle, the actuating member, and the follower.

3. The outer operational device as claimed in claim 2, with the follower including a second tooth on the outer periphery thereof, with the actuating member including a second groove in the inner periphery of the non-circular connecting hole, and with the second tooth engaged in the second groove.

4. The outer operational device as claimed in claim 1, further comprising, in combination: a spring including a first tang fixed to the cover and a second tang fixed to the limiting member, with the second tang being rotatable about a pivot axis defined by the first tang between first and second positions when the limiting member is pivoted between the release position and the blocking position, with the limiting member being retained in the release position by the spring when the second tang is in the first position, and with the limiting member being retained in the blocking position by the spring when the second tang is in the second position.

5. The outer operational device as claimed in claim 1, further comprising, in combination: a guide block mounted in the space, with the guide block including a sliding groove, with the driving member further including a base portion extending from an end of the rod, with the base portion being fixed to the sliding member, with the base portion including a guiding portion slideably received in the sliding groove, such that the guiding portion slides in the sliding groove when the sliding member moves.

6. The outer operational device as claimed in claim 1, with the body including a pivot hole in communication with the compartment, with first and second limiting blocks being formed on a side of the body along a periphery of the pivot hole, with each of the first and second blocks having an end, with the housing including an axial hole aligned with the pivot hole, with the rotatable member rotatably received in the axial hole and the pivot hole, with the rotatably member further including first and second blocks on an outer periphery thereof, with one of the first and second blocks coming in contact with and being stopped by the end of one of the first and second limiting blocks when the handle is rotated, limiting rotational movement of the handle.

7. The outer operational device as claimed in claim 6, with the rotatable member further including a flange on the outer periphery thereof, with a slit formed between the first block and an end of the flange, with the elastic element including a spiral section mounted around the first and second blocks, a first tang fixed to the body, and a second tang fixed in the slit.

8. The outer operational device as claimed in claim 1, with the cylinder including a threaded portion on an outer periphery thereof, with the outer operational device further comprising, in combination: a washer with inner threading threadedly engaged around the threaded portion, and with the mover rotatably mounted between the cover and the washer.

9. The outer operational device as claimed in claim 1, with the sidewall including a receiving portion extending into the space and forming a compartment, with the compartment including an opening in communication with the space, and with the cylinder received in the compartment.

10. An outer operational device for a panic exit door lock, comprising, in combination:

a cover adapted to be mounted to a side of a door, with the cover defining a space, with the cover including a sidewall extending in a vertical direction and an annular wall extending perpendicularly along a periphery of sidewall, with the space defined between the annular wall and the sidewall;

a handle including a shank having an engaging portion with non-circular cross sections, with the shank rotatably received in the cover;

an actuating member mounted in the space and including an end and a non-circular connecting hole engaged with the engaging portion to rotate therewith;

a sliding member slideably received in the space, with the sliding member including a pressing face abutting against the end of the actuating member, so that the sliding member slides when the actuating member rotates;

a limiting member pivotably received in the space, with the limiting member including a pivotal portion and a stop, with the stop including a follower portion, with the limiting member being pivotable between a blocking position not allowing movement of the sliding member and a release position allowing movement of the sliding member, with the handle being rotatable when the limiting member is in the release position, with the handle being not rotatable when the limiting member is in the blocking position;

a driving member fixed to the sliding member to move therewith, with the driving member including a rod adapted to couple with a panic exit door lock mounted to another side of the door, with the rod being movable to control locking or unlocking of the panic exit door lock;

a cylinder mounted to the cover and including a lock core rotatably mounted therein, with an actuator being mounted outside of the cylinder and fixed to the lock core to rotate therewith;

a mover rotatably mounted around the cylinder and including a tab and an actuating bar, with the tab being located in a path of rotational movement of the actuator and, thus, operably connected to the actuator, with the actuating bar being operably connected to follower portion, such that the mover is rotated to move the limiting member between the blocking position and the release position when the actuator is rotated, with the sidewall including a receiving portion extending into the space and forming a compartment, with the compartment including an opening in communication with the space, and with the cylinder received in the compartment, with the receiving portion including parallel, spaced, first and second chamfered faces on an outer periphery thereof, with the cylinder further including first and second positioning grooves in an outer periphery thereof, with the outer operational device further comprising, in combination: a lid including first and second lateral walls and an interconnecting wall interconnected between the first and second lateral walls, with the interconnecting wall including a hole through which the cylinder extends, with the hole including first and second projections on an inner periphery thereof, with the first and second projections engaged in the first and second positioning grooves to prevent rotation of the cylinder relative to the lid, with the first and second lateral walls abutting the first and second chamfered faces to prevent rotation of the lid relative to the receiving portion.

11. The outer operational device as claimed in claim 10, with each of the first and second lateral walls including upper and lower ends, with the lid further including an upper notch in a top thereof between the upper ends of the first and second lateral walls, with the lid further including a lower notch in a bottom thereof between the lower ends of the first and second lateral walls, with the actuating bar of the mover extending through the lower notch, with the lower notch limiting rotation of the actuating bar, with the mover further including a limiting bar extending through the upper notch, with the upper notch limiting rotation of the limiting bar, with the interconnecting wall of the lid further including a limiting groove, and with the tab extending through the limiting groove, with the limiting groove limiting rotation of the tab.

* * * * *